US007793624B2

(12) United States Patent
Janak et al.

(10) Patent No.: US 7,793,624 B2
(45) Date of Patent: Sep. 14, 2010

(54) ENGINE BRAKE APPARATUS

(75) Inventors: Robb Janak, Bristol, CT (US); Brian L. Ruggiero, East Granby, CT (US); Jonathan W. Prusak, West Hartland, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 109 days.

(21) Appl. No.: 11/976,793

(22) Filed: Oct. 29, 2007

(65) Prior Publication Data

US 2008/0196680 A1 Aug. 21, 2008

Related U.S. Application Data

(60) Provisional application No. 60/854,716, filed on Oct. 27, 2006.

(51) Int. Cl.
*F01L 9/02* (2006.01)

(52) U.S. Cl. ..... 123/90.12; 123/90.15; 123/90.16

(58) Field of Classification Search ..... 123/90.12, 123/90.15

See application file for complete search history.

(56) References Cited

U.S. PATENT DOCUMENTS

| | | | | |
|---|---|---|---|---|
| 4,742,806 | A | 5/1988 | Tart, Jr. et al. | |
| 6,321,701 | B1 | 11/2001 | Vorih et al. | |
| 6,647,938 | B2 * | 11/2003 | Gaessler et al. | 123/179.17 |
| 6,907,851 | B2 * | 6/2005 | Barnes et al. | 123/90.12 |
| 7,066,159 | B2 | 6/2006 | Ruggiero et al. | |
| 2004/0237932 | A1 * | 12/2004 | Persson | 123/321 |
| 2006/0005796 | A1 | 1/2006 | Janak et al. | |

* cited by examiner

*Primary Examiner*—Zelalem Eshete
(74) *Attorney, Agent, or Firm*—Kelley Drye & Warren

(57) ABSTRACT

Apparatus and methods for hydraulic valve actuation of engine valves are disclosed. An exemplary embodiment of the present invention may include a lost motion piston assembly that transfers motion between first and second rocker arms to selectively provide auxiliary engine valve actuation motions to the engine valves for engine operations such as engine braking and exhaust gas recirculation. The lost motion piston assembly may reduce or eliminate transient loads that may otherwise be transmitted to engine valve train elements during the times that lost motions systems are turned on and off for auxiliary valve actuations.

18 Claims, 9 Drawing Sheets

ENGINE BRAKE APPARATUS

CROSS-REFERENCE TO RELATED APPLICATIONS

The present application relates to, and claims the priority of, U.S. Provisional Patent Application Ser. No. 60/854,716, filed Oct. 27, 2006, which is entitled "Engine Brake Incorporating Transient Relief for Valvetrain and Method Thereof."

FIELD OF THE INVENTION

The present invention relates to methods and apparatus for actuating engine valves in an internal combustion engine.

BACKGROUND OF THE INVENTION

Valve actuation in an internal combustion engine is required in order for the engine to produce positive power. During positive power operation, one or more intake valves may be opened to admit fuel and/or air into a cylinder for combustion. One or more exhaust valves may be opened to allow combustion gas to escape from the cylinder. Intake, exhaust, and/or auxiliary valves also may be opened during positive power at various times to recirculate gases for improved emissions.

Valve actuation may also be required to produce auxiliary engine valve actuations, such as engine braking, for example. During compression-release type engine braking, the exhaust valves may be selectively opened to convert, at least temporarily, a power producing internal combustion engine into a power absorbing air compressor. As a piston travels upward during its compression stroke, the gases that are trapped in the cylinder may be compressed. The compressed gases may oppose the upward motion of the piston. As the piston approaches the top dead center (TDC) position, at least one exhaust valve may be opened to release the compressed gases in the cylinder to the exhaust manifold, preventing the energy stored in the compressed gases from being returned to the engine on the subsequent expansion down-stroke. In doing so, the engine may develop retarding power to help slow the vehicle down. An example of a prior art compression release engine brake is provided by the disclosure of the Cummins, U.S. Pat. No. 3,220,392 (November 1965), which is hereby incorporated by reference.

During bleeder type engine braking, in addition to, and/or in place of, the main exhaust valve event, which occurs during the exhaust stroke of the piston, the exhaust valve(s) may be held slightly open during the remaining three engine cycles (full-cycle bleeder brake) or during a portion of the remaining three engine cycles (partial-cycle bleeder brake). The bleeding of cylinder gases in and out of the cylinder may act to retard the engine. Usually, the initial opening of the braking valve(s) in a bleeder braking operation is in advance of the compression TDC (i.e., early valve actuation) and then lift is held constant for a period of time. As such, a bleeder type engine brake may require lower force to actuate the valve(s) due to early valve actuation, and generate less noise due to continuous bleeding instead of the rapid blow-down of a compression-release type brake.

Another auxiliary engine valve actuation is exhaust gas recirculation (EGR), during which a portion of the exhaust gases may flow back into the engine cylinder during positive power operation. EGR may be used to reduce the amount of $NO_x$ created by the engine during positive power operations. An EGR system can also be used to control the pressure and temperature in the exhaust manifold and engine cylinder during engine braking cycles. Generally, there are two types of EGR systems, internal and external. External EGR systems recirculate exhaust gases back into the engine cylinder by direct passage from the exhaust manifold to the intake manifold and then back into the cylinder through an intake valve(s). Internal EGR systems recirculate exhaust gases back into the engine cylinder from the exhaust manifold through an exhaust valve(s) and potentially back to the intake manifold from the engine cylinder through an intake valve(s). Embodiments of the present invention primarily concern internal EGR systems.

Still another auxiliary engine valve actuation is brake gas recirculation (BGR), during which a portion of the exhaust gases may flow back into the engine cylinder during engine braking operation. Recirculation of exhaust gases back into the engine cylinder during the intake stroke, for example, may increase the mass of gases in the cylinder that are available for compression-release braking. As a result, BGR may increase the braking effect realized from the braking event.

In many internal combustion engines, the intake and exhaust valves may be opened and closed by fixed profile cams, and more specifically by one or more fixed lobes that are an integral part of each of the cams. Benefits such as increased performance, improved fuel economy, lower emissions, and/or better vehicle driveability and braking may be obtained if the intake and exhaust valve timing and/or lift can be varied. The use of fixed profile cams, however, can make it difficult to adjust the timings and/or amounts of engine valve lift in order to optimize them for various engine operating conditions, such as different engine speeds.

One method of adjusting valve timing and lift, given a fixed cam profile, has been to provide a "lost motion" device in the valve train linkage between the valve and the cam. Lost motion is the term applied to a class of technical solutions for modifying the valve motion proscribed by a cam profile with a variable length mechanical, hydraulic, or other linkage assembly in the valve train. In a lost motion system, a cam lobe may provide the "maximum" lift motion needed over a full range of engine operating conditions. A variable length system may then be included in the valve train linkage, intermediate of the valve to be opened and the cam providing the maximum motion, to selectively extend the duration of the maximum lift past the duration provided by the cam and/or subtract or lose part or all of the lift provided by the cam.

This variable length system (or lost motion system) may, when expanded fully, transmit all of the cam motion to the valve and even extend the duration of the valve event beyond that normally provided by the cam, and when contracted fully, transmit none or a minimum amount of the cam motion to the valve. Examples of lost motion systems and methods are provided in Hu, U.S. Pat. Nos. 5,537,976 and 5,680,841, which are assigned to the same assignee as the present application and which are incorporated herein by reference.

A second example of a lost motion valve actuation system is disclosed in published U.S. patent application Ser. No. 11/123,063 ("the '063 application"), filed May 6, 2005, and published on Jan. 12, 2006 as publication number US 2006/0005796, which is incorporated herein by reference. The '063 application discloses a valve actuation system that utilizes a primary rocker arm and an auxiliary rocker disposed adjacent to each other on a rocker arm shaft. The primary rocker arm may actuate an engine valve for primary valve actuation motions, such as main exhaust events, in response to an input from a first valve train element, such as a cam lobe. The auxiliary rocker arm may receive one or more auxiliary valve actuation motions, such as for engine braking, exhaust gas recirculation, and/or brake gas recirculation events, from a second valve train element, such as a second cam lobe. An adjustable hydraulic actuator piston may be disposed between the auxiliary rocker arm and the primary rocker arm. The actuator piston may be selectively locked into an extended position between the primary and auxiliary rocker arms so as to selectively transfer one or more auxiliary valve actuation motions from the auxiliary rocker arm to the primary rocker arm and thereafter to the engine valve. The hydraulic actuator piston may be preferably provided in either the primary or the auxiliary rocker arm.

While various embodiments of the present invention may be used particularly in connection with a primary rocker arm and auxiliary rocker arm system such as that disclosed in the '063 application, no embodiments should be limited to use with only such systems. Thus, the hydraulic fluid systems, and methods of operation thereof, which are disclosed in the present application may provide improved valve actuation for compression-release engine braking, bleeder type engine braking, exhaust gas recirculation, brake gas recirculation, and/or any other auxiliary valve events carried out by a system such as that disclosed in the '063 application. More specifically, various embodiments of the present invention may reduce or eliminate transient loads experienced by valve train elements, such as engine valves, rocker arms, rocker shafts, push tubes and/or cams, when the auxiliary rocker arm first engages and disengages the primary rocker arm for auxiliary engine valve events, such as engine braking, etc.

Additional advantages of the invention are set forth, in part, in the description that follows and, in part, will be apparent to one of ordinary skill in the art from the description and/or from the practice of the invention.

SUMMARY OF THE INVENTION

Applicants have developed an innovative system for transferring engine valve actuation motion between first and second valve train elements, said system comprising: an actuator piston bore formed in the second valve train element; an actuator piston slideably disposed in the actuator piston bore; a solenoid control valve; a first hydraulic fluid supply passage connected to the solenoid control valve; a hydraulic circuit extending between the actuator piston bore and the solenoid control valve; a solenoid actuated valve disposed in said hydraulic circuit between the solenoid valve and the actuator piston bore; and a means for expanding the volume of the hydraulic circuit during times when the solenoid control valve opens to provide hydraulic fluid from the first hydraulic fluid supply passage to the solenoid actuated valve.

Applicants have also developed an innovative system for transferring engine valve actuation motion between first and second valve train elements, said system comprising: an actuator piston bore formed in the second valve train element; an actuator piston slideably disposed in the actuator piston bore; a solenoid control valve; a first hydraulic fluid supply passage connected to the solenoid control valve; a solenoid actuated valve bore in hydraulic communication with the solenoid control valve; a solenoid actuated valve piston slideably disposed in the solenoid actuated valve bore, said solenoid actuated valve piston having first, second and third annular recesses; means for biasing the solenoid actuated valve piston towards the solenoid control valve; a second hydraulic fluid supply passage connected to the solenoid actuated valve bore; a first hydraulic fluid vent passage connected to the solenoid actuated valve bore; a second hydraulic fluid vent passage connected to the solenoid actuated valve bore; a first actuator hydraulic passage extending between an upper portion of the actuator bore and the solenoid actuated valve bore; and a second actuator hydraulic passage extending between a lower portion of the actuator bore and the solenoid actuated valve bore, wherein the position of the solenoid actuated valve piston is selectively controlled by the solenoid control valve to provide hydraulic communication (1) between the second hydraulic fluid supply passage and the first actuator hydraulic passage, and between the second hydraulic fluid vent passage and the second actuator hydraulic passage, and (2) between the second hydraulic fluid supply passage and the second actuator hydraulic passage, and between the first hydraulic fluid vent passage and the first actuator hydraulic passage.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF THE PRESENT INVENTION

As embodied herein, the present invention includes both systems and methods of controlling the actuation of engine valves for auxiliary engine valve actuation events, such as, but not limited to, engine braking. Reference will now be made in detail to a first embodiment of the present invention, an example of which is illustrated in the accompanying drawings.

Figure 1:
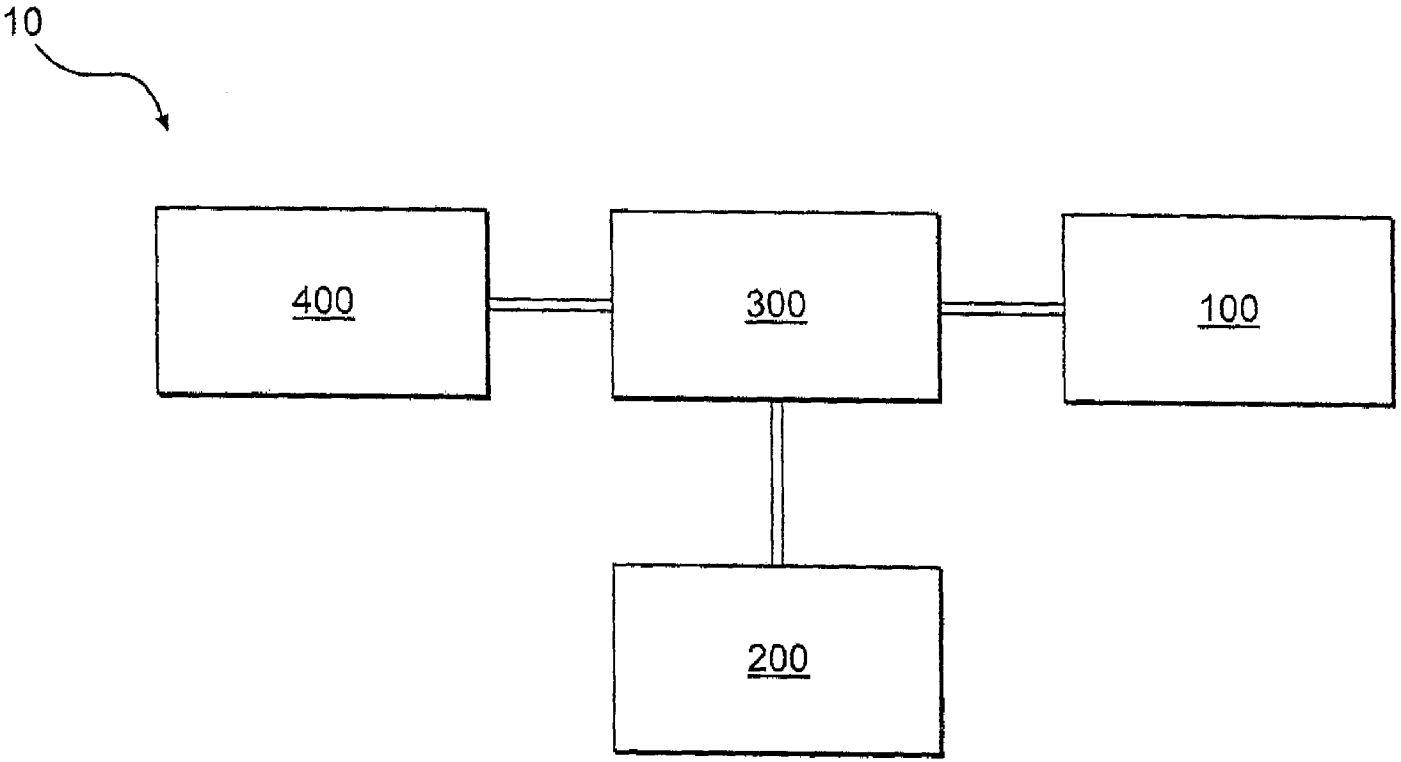
FIG. 1 is a block diagram of a valve actuation system according to an exemplary embodiment of the present invention.

A first embodiment of the present invention is shown in FIG. 1 as valve actuation system 10. The valve actuation system 10 may include a means for imparting motion 100 operatively connected to a hydraulic valve actuation system 300, which in turn is operatively connected to one or more engine valves 200. The engine valves 200 may be exhaust valves, intake valves, or auxiliary valves. The motion imparting means 100 may include any combination of cam(s), push tube(s), rocker arm(s) or other valve train element(s) that provide an input motion to the hydraulic valve actuation system 300. For ease of discussion, the means for imparting motion will be referred to hereinafter as a rocker arm 100. Examples of means for imparting motion, including rocker arms that may be used in conjunction with the present invention are described in U.S. Patent Publication No. 2006-0005796, which is assigned to the same assignee as the present application and which is incorporated herein by reference.

The hydraulic valve actuation system 300 may selectively lose the motion input by the rocker arm 100, transfer the motion input from the rocker arm 100 to the engine valves 200, and in some embodiments, extend the duration of the motion input from the rocker arm to the engine valves in response to a signal or input from a control means 400. The motion transferred to the engine valves 200 and the loss of such motion may be used to produce various engine valve events, such as, but not limited to, main intake, main exhaust, compression-release engine braking, bleeder braking, external and/or internal exhaust gas recirculation, early exhaust valve opening, early intake closing, centered lift, late exhaust and intake valve closing, etc.

The hydraulic valve actuation system 300 may comprise any structure that at least in part hydraulically actuates the engine valves 200. The hydraulic valve actuation system 300 may comprise, for example, a mechanical linkage, a hydraulic circuit, a hydro-mechanical linkage, an electromechanical linkage, and/or any other linkage adapted to attain more than one operative length and actuate an engine valve.

The control means 400 may comprise any electronic or mechanical device for communicating with the hydraulic valve actuation system 300. The control means 400 may include a microprocessor, linked to an appropriate vehicle component(s), to determine and select the appropriate mode of the lost motion system 300. The vehicle component may include, without limitation, an engine speed sensing means, a clutch position sensing means, a fuel position sensing means, and/or a vehicle speed sensing means. Under prescribed conditions, the control means 400 may produce a signal and transmit the signal to the hydraulic valve actuation system 300, which will, in turn, switch to the appropriate mode of operation. For example, when the control means 400 determines that auxiliary valve actuation, such as engine braking, is desired, based on a condition, such as, idle fuel, engaged clutch, and/or an engine RPM greater than a certain speed, the control means 400 may produce and transmit a signal to the hydraulic valve actuation system 300 to switch to engine braking mode. It is contemplated that the valve actuation system 10 may be designed such that valve actuation may be optimized at one or more engine speeds and engine operating conditions.

Figure 2:
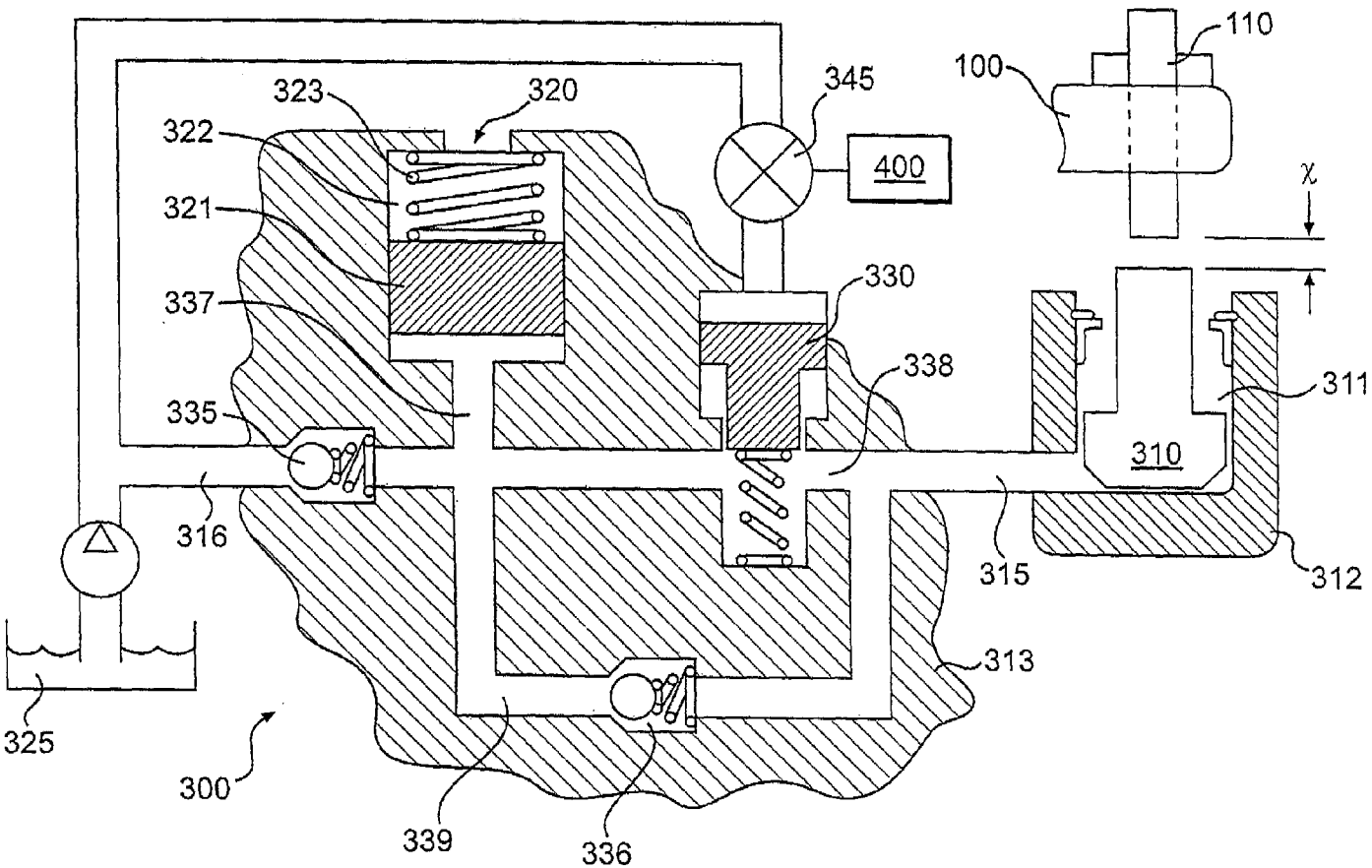
FIG. 2 is a schematic diagram of the auxiliary valve actuation "off" position of a valve actuation system according to a first embodiment of the present invention.
Figure 3:
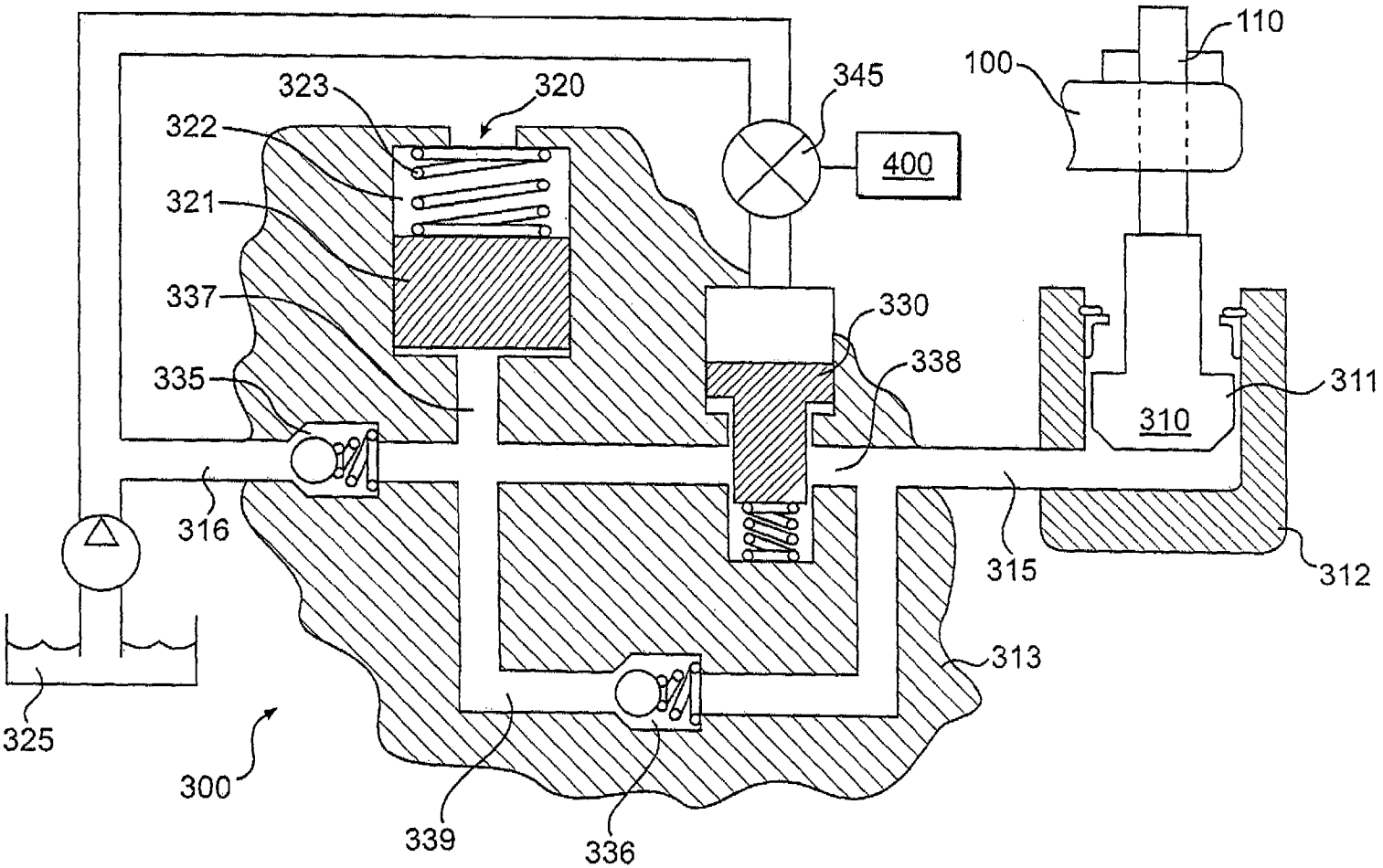
FIG. 3 is a schematic diagram of the auxiliary valve actuation "on" position of the valve actuation system according to the first embodiment of the present invention.

An exemplary embodiment of a portion of the hydraulic valve actuation system 300 depicting an auxiliary valve actuation "off" position is shown in FIG. 2. A corresponding auxiliary valve actuation "on" position is shown in FIG. 3. With reference thereto, the valve actuation system 300 may include an actuator piston 310, a hydraulic circuit 315 formed within a housing 313 (shown in cut-out section), an accumulator 320, a solenoid control valve 345, a hydraulic fluid supply source 325, and a solenoid actuated valve 330. The valve actuation system 300 may also include first and second check valves 335, 336, respectively.

The actuator piston 310 may selectively contact a rocker arm 100, which in turn may transfer the motion input to or from the rocker arm 100 to or from the valve actuation system 300 and on to the engine valves (not shown). The rocker arm 100 may include a lash adjustment assembly 110 used to adjust the lash space x between the rocker arm 100 and the actuator piston 310. The actuator piston 310 may be slidably disposed in a bore 311 formed in a piston housing 312 such that it may slide back and forth in the bore 311 while maintaining a hydraulic seal with the housing 312. In a preferred embodiment, the housing 312 may be incorporated into a second rocker arm which either receives motion from a cam (not shown) to be transferred to the first rocker arm 100, or alternatively, receives motion from the first rocker arm 100 to be transferred to the engine valves. The essential feature of the actuator piston 310 is that it is disposed between first and second valve train elements, which are preferably rocker arms, that contact each other through the actuator piston 310 to transfer motion from a cam or other motion imparting means to one or more engine valves. Accordingly, one end of the actuator piston 310 may selectively contact the rocker arm 100 to transfer motion input from a cam (not shown) from one rocker arm to the other.

The hydraulic circuit 315 may comprise any combination of hydraulic passages adapted to achieve the objects of the system 10. In one embodiment, as shown in FIG. 2, the hydraulic circuit 315 comprises a constant supply passage 316 connecting the actuator piston 310 to the hydraulic fluid supply source 325. The constant supply passage 316 may also be connected to the solenoid control valve 345. The hydraulic circuit 315 may include a first portion 337 connecting the hydraulic circuit to the accumulator 320, a second portion 338 bisected by the solenoid actuated valve 330, and a third portion 339 which houses the second check valve 336 and bypasses the solenoid actuated valve 330.

The solenoid actuated valve 330 may incorporate a two-diameter piston which is spring biased into a valve-open position, as shown in FIG. 2. The diameter of the portion of the two-diameter piston that is proximal to the solenoid control valve 345 may be sufficiently greater that the diameter of the portion of the piston that is distal from the solenoid control valve so that when the hydraulic circuit 315 is at low pressure, the hydraulic pressure applied from the solenoid control valve side of the two-diameter piston is greater than the pressure on the hydraulic circuit 315 side of the two-diameter piston. Further, the bore within which the spring biasing the two-diameter piston resides may be vented to atmosphere (not shown) to prevent hydraulic pressure in the bore from opposing the solenoid actuated valve 330 from traveling downward to assume the position shown in FIG. 3. In alternative embodiments of the present invention the solenoid actuated valve 330 may be, for example, a spool valve or a slug valve.

The accumulator 320 may include an accumulator piston 321 slideably disposed in an accumulator bore 322 and biased into the accumulator bore by an accumulator spring 323. The spring load of the accumulator spring 322 is preferably greater than the maximum pressure generated in the constant supply passage 316, which is typically at a low pressure of between 20-50 psi.

With continued reference to FIGS. 1 through 3, the valve actuation system 300 may operate as follows. The system 300 may be initially charged with oil, or some other hydraulic fluid, through the first check valve 335 after the engine is started. The solenoid actuated valve 330 may be kept open at this time, as shown in FIG. 2, to allow oil to charge the passages of the hydraulic circuit 315 and to fill the piston bore 311. The system 300 may be maintained in this state while the engine is in a positive power mode of operation. The low pressure hydraulic fluid from the hydraulic fluid supply 325 may cause the actuator piston 310 to travel upward until it contacts the first rocker arm 100.

During positive power operation of the engine, the actuator piston 310 is not locked into position, however, and accordingly, any motion input to the housing 312 (which is preferably disposed in a second rocker arm) or to the first rocker arm 100, will cause the actuator piston 310 to recede into the piston bore 311 and drive the hydraulic fluid under the actuator piston 310 back into the hydraulic circuit 315. The equivalent volume of hydraulic fluid pushed out of the piston bore 311 may be absorbed by the accumulator 320. When the first rocker arm 100 and the housing 312 move apart again as the cam imparting motion to one of the rocker arms rotates back to base circle, the accumulator spring 322 may push the accumulator piston 321 back into the accumulator bore and cause the equivalent volume of fluid absorbed by the accumulator 320 to be pushed back into the piston bore 311. In this manner hydraulic fluid is free to flow between the accumulator 320 and the piston bore 311 during positive power operation of the engine.

To initiate engine braking operation, the controller 400 may open the solenoid control valve 345 so that hydraulic fluid from the constant supply passage 316 flows into the solenoid actuated valve 330. As a result, the solenoid actuated valve 330 may close, as shown in FIG. 3. Once the solenoid actuated valve 330 is closed, the actuator piston 310 may be locked into a relatively fixed position relative to the housing 312.

Absent the accumulator 320, closing the solenoid actuated valve 330 during the time that the actuator piston 310 is transitioning downward in the piston bore 311 could cause the solenoid actuated valve to return to the "off" position shown in FIG. 2 resulting in the transmission of undesired transient loads to the first rocker arm 100, the second rocker arm, and/or other valve train elements. The connection of the accumulator 320 to the hydraulic circuit 315 may reduce or eliminate such transient loads by providing a repository for hydraulic fluid that is displaced by the downward motion of the actuator piston 310. In other words, the engine valve(s) used for engine braking are not opened until the solenoid actuated valve 330 is fully in the auxiliary valve actuation "on" position. In this manner, the accumulator 320 effectively increases the volume of the hydraulic circuit communicating with the piston bore 311 during the time the system is turned "on" which may reduce or eliminate excessive valve train loading during the same period.

In alternative embodiments of the present invention the controller 400 may select a desired level of engine valve actuation and determine the required position of the actuator piston 310 to achieve the desired level of valve actuation. When doing so, the controller 400 may selectively open the solenoid actuated valve 330 so that hydraulic fluid may escape from the bore 311 as the rocker arm 100 forces the actuator piston 310 into the bore 311. If the rocker arm 100 is not in position to force the actuator piston 310 downward, opening the solenoid actuated valve 330 may result in the addition of hydraulic fluid to the bore 311. Once the solenoid actuated valve 330 is closed again, the actuator piston 310 may be locked into position to transfer motion between the first rocker arm 100 and the housing 312.

Figure 4:
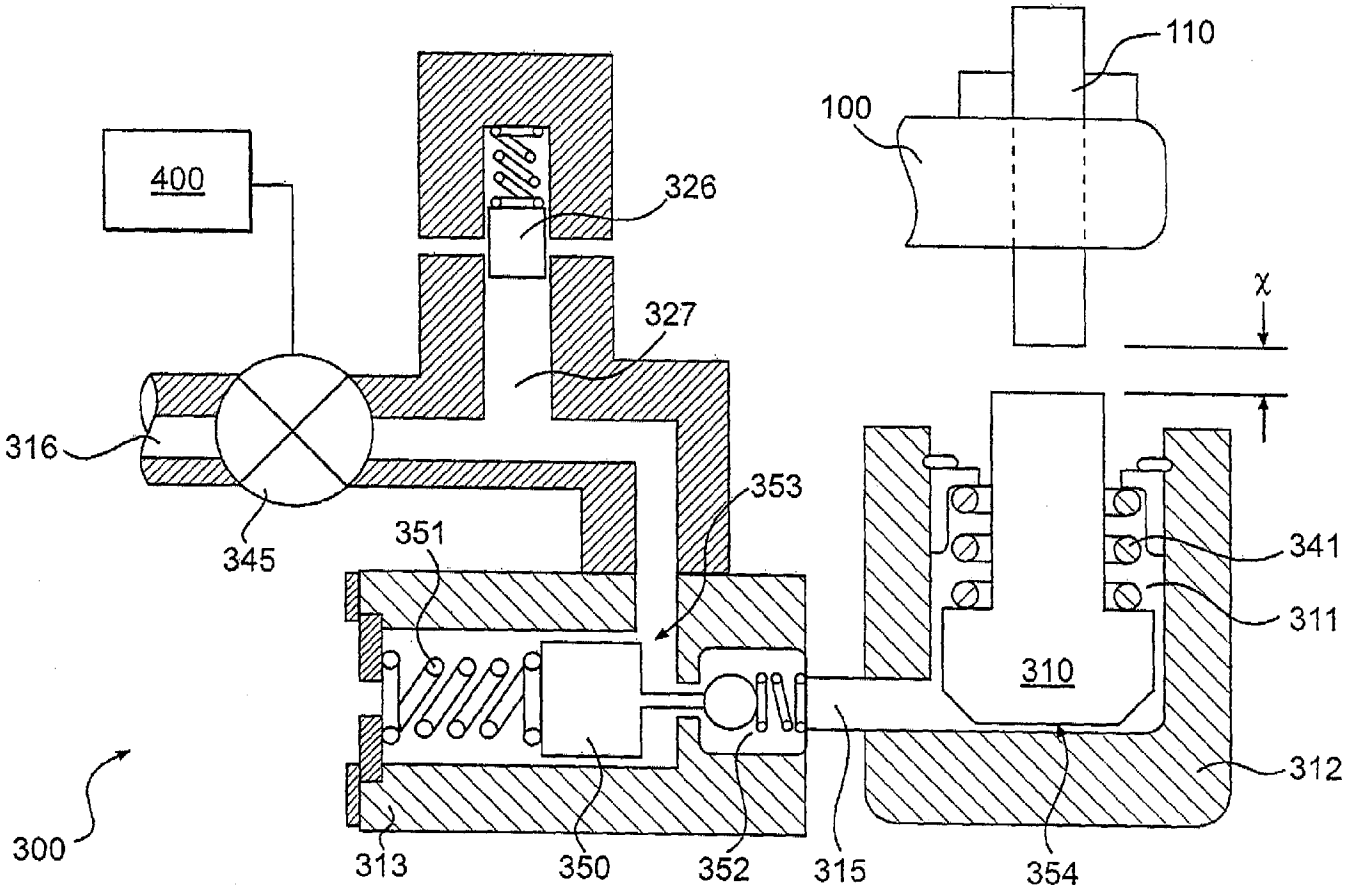
FIG. 4 is a schematic diagram of the auxiliary valve actuation "off" position of a valve actuation system according to a second embodiment of the present invention.
Figure 5:
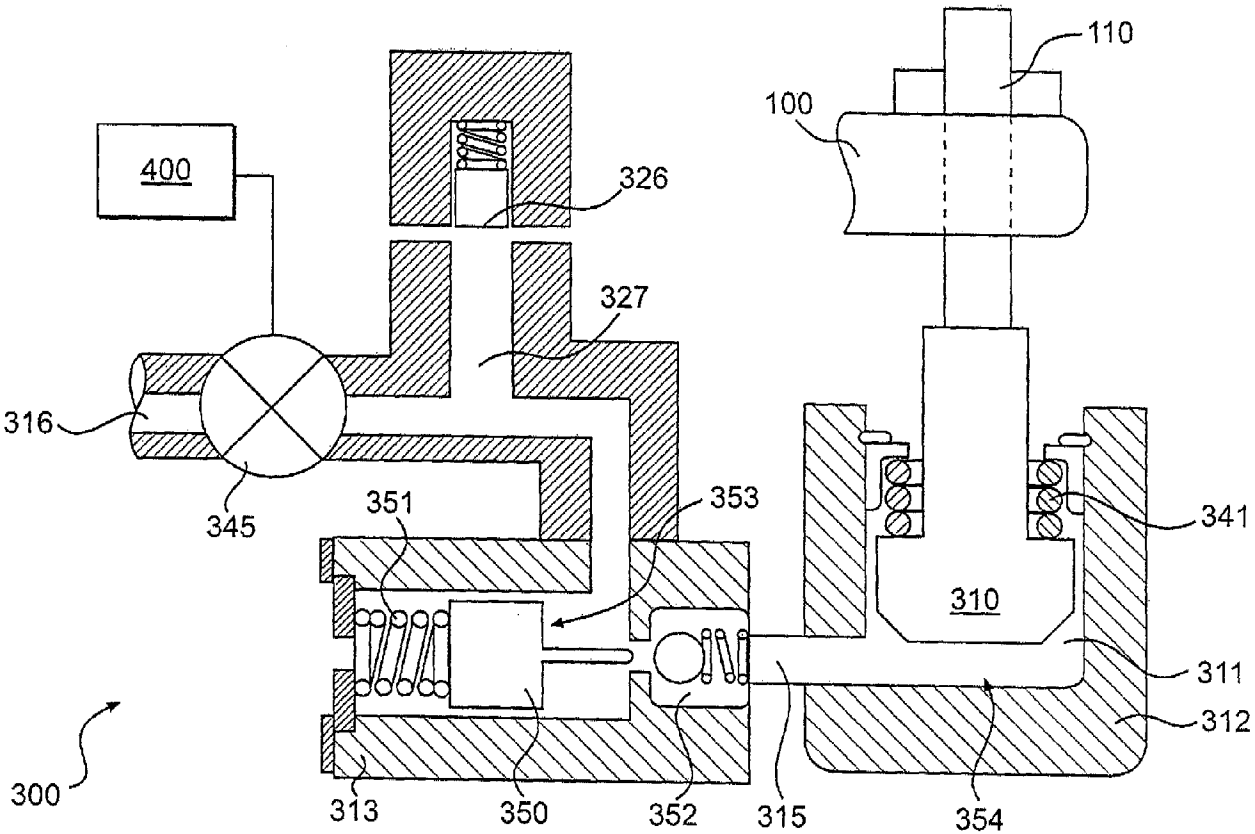
FIG. 5 is a schematic diagram of the auxiliary valve actuation "on" position of the valve actuation system according to the second embodiment of the present invention.

A second embodiment of the present invention is shown in FIGS. 4 and 5 as valve actuation system 300. Like reference numbers are used to refer to like elements in the FIGS. 1-5. In the second embodiment, the valve actuation system 300 may include a actuator piston 310 slidably disposed in a bore 311 provided in a housing 312. The actuator piston 310 may be biased into the bore 311 by a spring 341 having a specified spring load $L_1$. The actuator piston 310 may have a bottom surface with a specified surface area $A_1$ on which hydraulic fluid pressure may act. A lash space x may be provided between the outer end of the actuator piston 310 and a first rocker arm 100.

A hydraulic circuit 315 may connect the bore 311 to the remainder of the hydraulic valve actuation system 300 disposed in a housing 313. The hydraulic circuit may further include a solenoid control valve 345 connected to a constant hydraulic fluid supply passage 316, an optional pressure relief passage 327, an optional pressure relief valve 326, a poker piston 350, and a check valve 352. The poker piston 350 may include a pin-shaped extension adapted to selectively open the check valve 352. The poker piston 350 may also have a surface 353 with a specified surface area $A_2$ from which the pin-shaped extension extends. A poker spring 351 having a spring load $L_2$ may bias the poker piston 350 toward the check valve 352. Preferably, the actuator piston 310 bottom surface 354 area $A_1$ is greater than the poker piston surface 353 area $A_2$. It is also preferable that the pressure of the hydraulic fluid provided by the constant hydraulic fluid supply passage 316 be greater that the poker spring 351 spring load $L_2$, which in turn should be greater than the piston spring 341 spring load $L_1$. The force of the spring biasing the pressure relief valve 326 into a closed position, as shown in FIG. 3, should be greater than the pressure of the hydraulic fluid provided by the constant hydraulic fluid supply passage 316.

With continued reference to FIGS. 4 and 5, during positive power operation of the engine, the controller 400 may maintain the solenoid control valve 345 closed so that no appreciable amount of hydraulic fluid is provided to the hydraulic circuit 315. As a result, the poker spring 351 may bias the poker piston 350 into the check valve 352 so that the check valve is maintained open. In turn, the actuator piston 310 may be maintained in its lower most position in the bore 311 because there is insufficient hydraulic pressure under the actuator piston 310 to oppose the bias force of the piston spring 341.

For engine braking or other auxiliary valve actuation, the valve actuation system 300 may be activated by opening the solenoid valve 345 under the control of the controller 400. This may permit hydraulic fluid to be supplied to the hydraulic circuit 315 from the supply passage 316. As the hydraulic circuit 315 fills, the actuator piston 310 may first move upward into contact with the first rocker arm 100 by the build-up of hydraulic pressure in the bore 311 because the actuator piston 310 is biased downward by the spring 341 with the lightest relative spring load. As the pressure in the hydraulic circuit 315 builds further, the poker piston 350 may begin to move from the "off" position shown in FIG. 4, to a position where the poker piston 350 permits the check valve 352 to lock the portion of the hydraulic circuit 315 in communication with the bore 311, as shown in FIG. 5.

If the actuator piston 310 experiences any downward movement due to the upward motion of the housing 312 or the downward motion of the first rocker arm 100 before the check valve 352 is permitted to close, the transient load that might otherwise be transmitted to the valve actuation system or other portions of the valve train, may be absorbed through the open solenoid control valve 345 to the constant supply passage 316 and/or through the optional pressure relief passage 327 and/or operation of the optional pressure relief valve 326. In this manner, the poker piston 350 with a spring 351 with a specified spring load value and the actuator piston 310 with a spring 341 with a specified spring load value may effectively increase the volume of the hydraulic circuit communicating with the piston bore 311 during the time the system is turned "on."

After the poker piston 350 is pushed fully out of contact with the check valve 352, the hydraulic fluid in the piston bore 311 under the actuator piston 310 may lock the actuator piston 310 into a fixed position due to the operation of the check valve 352. Once, the actuator piston 310 is locked into position, valve actuation motion may be transferred between the actuator piston 310 and the first rocker arm 100.

Figure 6:
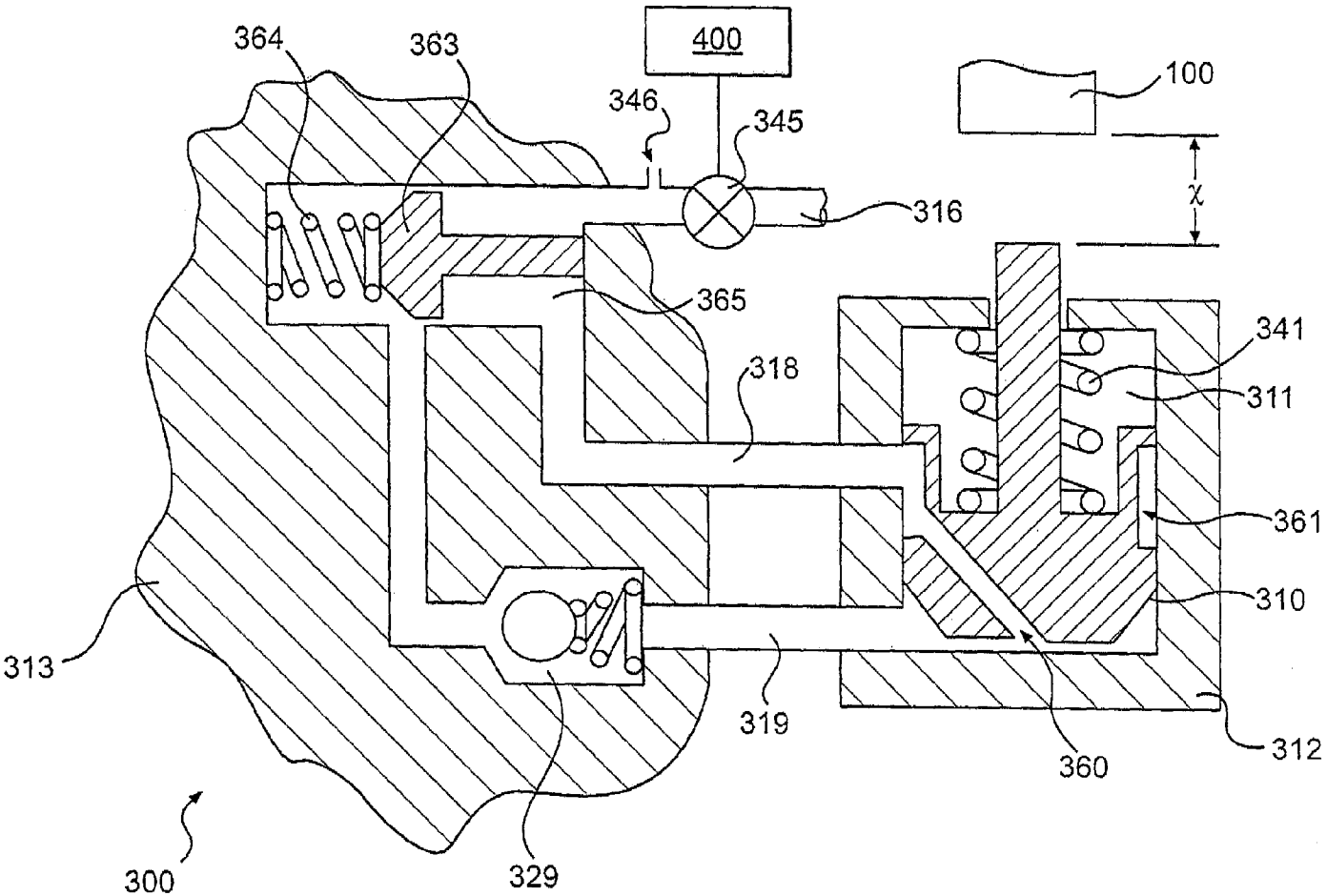
FIG. 6 is a schematic diagram of the auxiliary valve actuation "off" position of a valve actuation system according to a third embodiment of the present invention.
Figure 7:
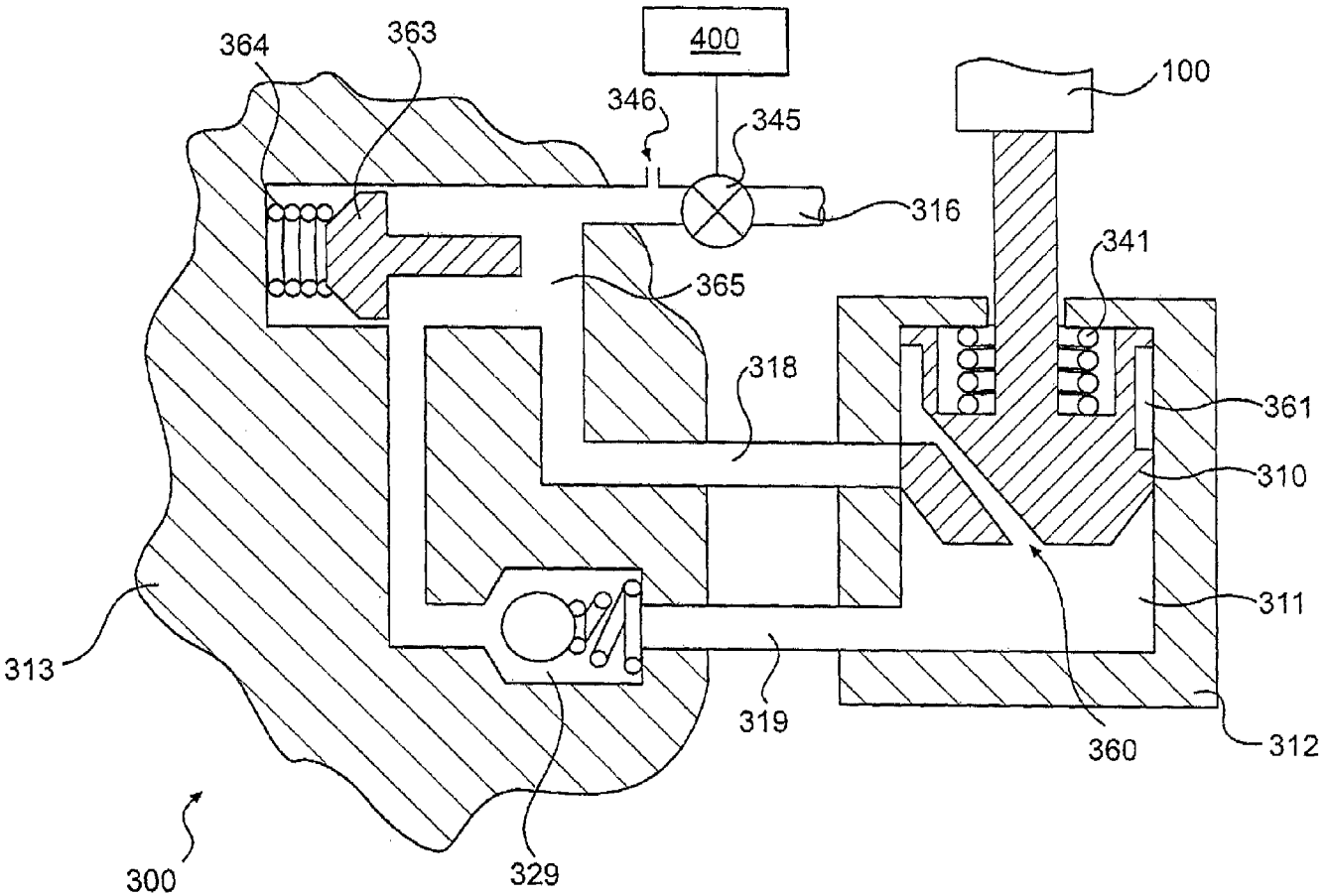
FIG. 7 is a schematic diagram of the auxiliary valve actuation "on" position of the valve actuation system according to the third embodiment of the present invention.

A third embodiment of the invention is shown in FIGS. 6 and 7 as valve actuation system 300. In the third embodiment, the valve actuation system 300 may include a actuator piston 310 slidably disposed in a bore 311 provided in a housing 312. The actuator piston 310 may include one or more vent passages 360 extending from the bottom surface of the actuator piston to an annular recess 361 provided in the side wall of the actuator piston. A piston spring 341 may bias the actuator piston 310 into the bore 311.

A first hydraulic passage 318 may extend from the side wall of the bore 311 to a solenoid actuated valve 365. The first hydraulic passage 318 may be provided along the side wall of the bore 311 such that it registers with the annular recess 361 when the actuator piston 310 is fully pushed into the bore by the piston spring 341, as shown in FIG. 6. A second hydraulic passage 319 may extend from a lower portion of the bore 311 to the solenoid actuated valve 365. A check valve 329 may be provided in the second hydraulic passage 319.

The solenoid actuated valve 365 may include a slug 363 and a slug spring 364. A solenoid control valve 345 may be connected to the solenoid actuated valve 365 by a third hydraulic passage. A constant hydraulic supply passage 316 may be connected to the solenoid control valve 345. A controller 400 may control the opening and closing of the solenoid control valve to selectively provide hydraulic fluid to the solenoid actuated valve 365.

During positive power operation, the solenoid control valve 345 may be maintained closed so that no appreciable amount of hydraulic fluid is provided to the solenoid actuated valve 365. As a result, the slug 363 may be biased by the slug spring 364 into a position isolating the second hydraulic passage 319 from the solenoid control valve 345, as shown in FIG. 6. The lack of appreciable hydraulic fluid pressure in the first and second hydraulic passages 318 and 319 permits the piston spring 341 to maintain the actuator piston 310 in the position shown in FIG. 6 with a lash space x between the piston 341 and the first rocker arm 100.

In order to institute engine braking or other auxiliary valve actuation, the solenoid control valve 345 may be opened by the controller 400 so that hydraulic fluid from the constant hydraulic fluid supply passage 316 is provided to the solenoid actuated valve 365. The low pressure fluid from the constant supply passage 316 may push the slug 363 into the position shown in FIG. 7 so that hydraulic fluid pressure is applied to the actuator piston 310 through the first and second passages 318 and 319. As a result, the actuator piston 310 may be pushed upward against the bias of the piston spring 341 until the actuator piston reaches the upper limit of the bore 311 or contacts the first rocker arm 100. The size of the actuator piston 310 and the annular recess 361 may be selected so that the annular recess is slightly out of registration with the first passage 318 when the actuator piston 310 is in its upper most position, as shown in FIG. 7. The actuator piston 310 may then become locked into its upper most position due to the check valve 329 preventing the backflow of hydraulic fluid through the second passage 319. Once, the actuator piston 310 is locked into position, valve actuation motion may be transferred between the actuator piston 310 and the first rocker arm 100.

In the event that the first rocker arm 100 pushes downward on the actuator piston 310 before the actuator piston is locked in its upward most position, the transient loads that might other wise be transmitted to the valve train may be reduced or eliminated by the slug 363 absorbing the back flow of hydraulic fluid. In this manner, the slug 363 effectively increases the volume of the hydraulic circuit communicating with the piston bore 311.

When engine braking or other auxiliary engine valve actuation is no longer desired, the solenoid control valve 345 may be closed. An optional small hydraulic fluid vent 346 may be provided in the third hydraulic passage between the solenoid control valve 345 and the solenoid actuated valve 365. The optional vent 346 and/or other leakage in the system, may permit the hydraulic pressure in the second passage 319 to subside if the actuator piston 310 slides downward just slightly enough for the annular recess 361 to register with the first passage 318. A small amount of leakage of hydraulic fluid from the bore 311 either past the check valve 329 or past the side wall of the actuator piston 310 may permit the actuator piston 310 to slide downward enough for the annular recess 361 to register with the first passage 318. Once registration occurs between the annular recess 361 and the first passage 318, the remaining hydraulic fluid under the actuator piston 310 may vent through the one or more vent passages 360, and the first passage 318, to the optional hydraulic vent 346 or to the constant hydraulic fluid supply passage 316.

It should be noted that performance of the valve actuation system illustrated by FIGS. 6 and 7 may be affected by both location and geometry of the actuator piston 310 outer diameter, actuator piston vent passage 360, and first passage 318. Further, the volume of hydraulic fluid that is displaced to relieve transient loading may help other valve actuation system components in the same circuit turn on more quickly than in a normal operation since the hydraulic fluid does not leave the circuit.

With continued reference to FIGS. 6 and 7, the ability of the system to reduce the transmission of transient loads may be assisted by the slug 363 effectively serving as an accumulator during the time the engine brake or auxiliary valve actuation system 300 is being turned off and/or turned on. For example, during the time the system 300 is turning on, any incomplete stroke of the actuator piston 310 may result in hydraulic fluid displacing the slug 363 rather than resulting in transmission of a transient load to the system. During the time the system 300 is turning off, and hydraulic fluid is escaping through the vent 346 and all of the actuator pistons 310 connected to the same solenoid control valve 345 are being pressed back into their respective bores 311, the ability of the slug 363 to absorb hydraulic fluid like an accumulator may permit the actuator pistons 310 to return to the position shown in FIG. 6 more quickly.

Figure 8:
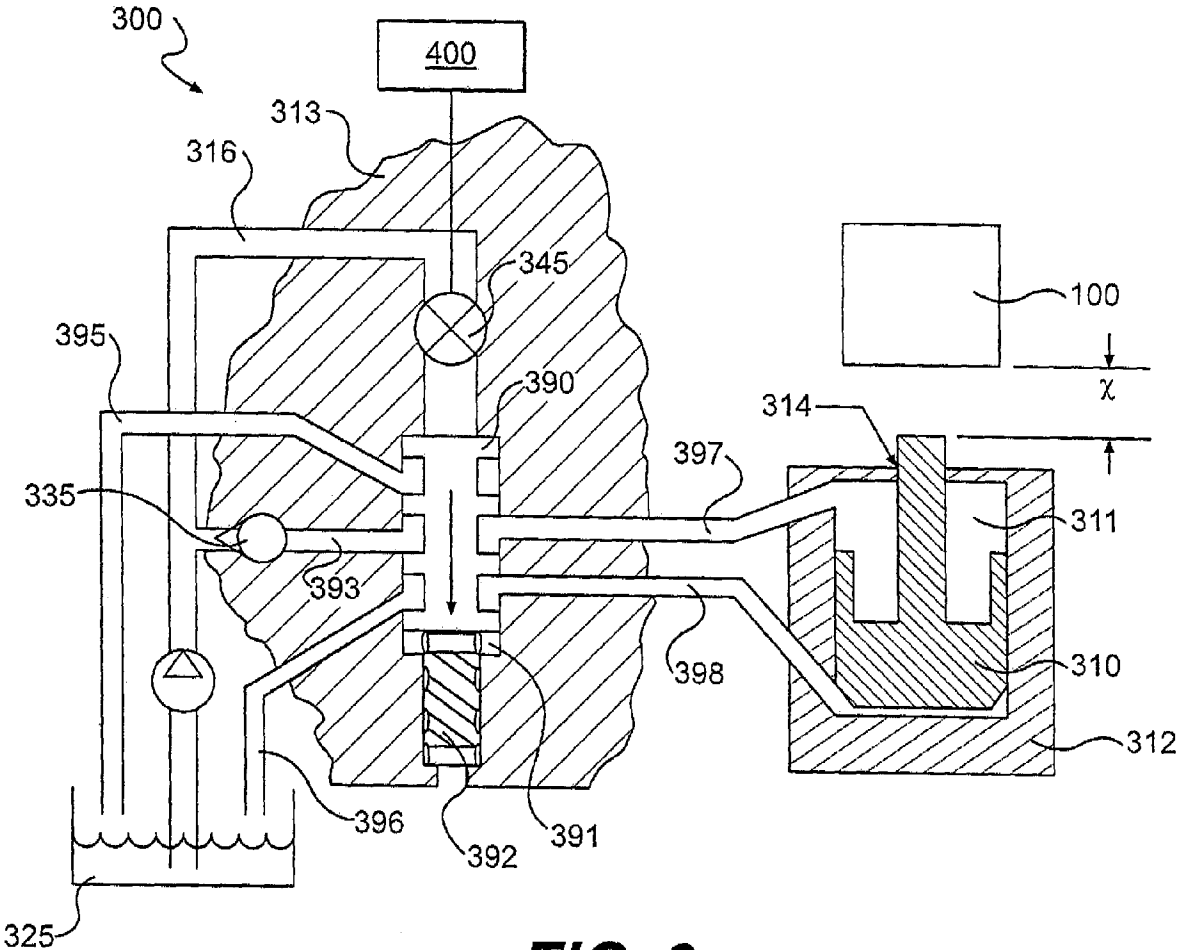
FIG. 8 is a schematic diagram of the auxiliary valve actuation "off" position of a valve actuation system according to a fourth embodiment of the present invention.
Figure 9:
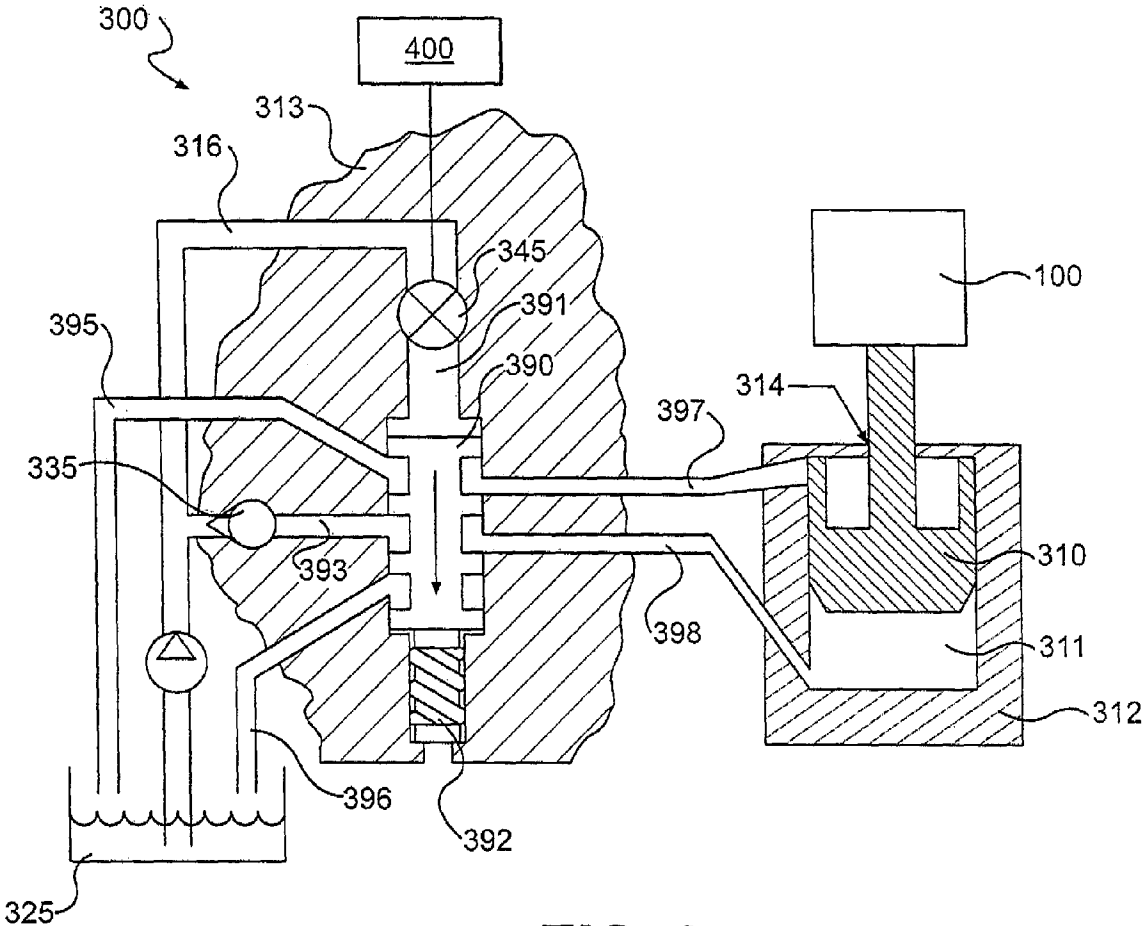
FIG. 9 is a schematic diagram of the auxiliary valve actuation "on" position of the valve actuation system according to the fourth embodiment of the present invention.

A fourth embodiment of the invention is shown in FIGS. 8 and 9, in which like reference numerals refer to like elements shown in the other drawing figures. In the fourth embodiment of the present invention, the valve actuation system 300 may be provided in first and second housings 312 and 313, respectively. The first housing 312 may have a piston bore 311 in which a actuator piston 310 is slideably disposed. The actuator piston 310 may include a central upper extension that forms at least a partial hydraulic seal 314 with the first housing 312.

With continued reference to FIGS. 8 and 9, a solenoid actuated piston 390 having first, second and third annular recesses longitudinally spaced along the axis of the piston may be slideably disposed in a bore 391 provided in the second housing 313. The solenoid actuated piston 390 may be biased into a first position by a spring 392, as shown in FIG. 8. Hydraulic fluid may be provided from a hydraulic fluid supply 325 through a constant supply passage 316 to a solenoid control valve 345 and a check valve 335. The solenoid control valve 345 may selectively supply hydraulic fluid from the constant supply passage 316 to the bore 391 under the control of a controller 400. Hydraulic fluid may also be constantly supplied to the bore 391 through the housing supply passage 393 extending between the check valve 335 and the bore 391. Selectively spaced first and second actuator passages 397 and 398, respectively, may extend from the bore 391 to the actuator piston bore 311. Selectively spaced first and second vent passages 395 and 396 may extend from the bore 391 to the hydraulic fluid supply 325 either directly or by venting to a location from which the hydraulic fluid may eventually return to the hydraulic fluid supply 325.

During positive power operation of the engine, the solenoid control valve 345 may be maintained closed so that the solenoid actuated piston 390 is biased by the spring 392 into the position shown in FIG. 8. As a result, the second annular recess provided on the piston 390 may place the first actuator passage 397 into hydraulic communication with the housing supply passage 393, and the third annular recess on the piston 390 may place the second actuator passage 398 into hydraulic communication with the second vent passage 396. The foregoing position of the piston 390 may cause hydraulic fluid to be provided in the actuator piston bore 311 above the actuator piston 310 while venting hydraulic fluid in the bore 311 below the actuator piston 310. Creation of a lash space x may result between the actuator piston 310 and the first rocker arm 100 so that no motion is transferred between the first rocker arm and the actuator piston during positive power operation.

In order to provide an auxiliary valve actuation operation, the solenoid actuated valve 345 may be opened causing the piston 390 to move into the position shown in FIG. 9 against the bias of the spring 392. As a result, the second annular recess provided on the piston 390 may place the second actuator passage 398 into hydraulic communication with the housing supply passage 393, and the first annular recess on the piston 390 may place the first actuator passage 397 into hydraulic communication with the first vent passage 395. The foregoing position of the piston 390 may cause hydraulic fluid to be provided in the actuator piston bore 311 below the actuator piston 310 while venting hydraulic fluid in the bore 311 above the actuator piston 310. This may cause the actuator piston 310 to move upward into contact with the first rocker arm 100. Transient loads that might otherwise be transmitted to the valve train if the actuator piston 310 moved downward during the time the system is turning "on" may be reduced or eliminated by the foregoing arrangement. One potential, but not required, advantage of this embodiment may arise from the use of hydraulic fluid rather than a spring to bias the actuator piston which may prevent piston motion during operation and allow inertia of the actuator piston to optimize auxiliary valve actuation turn-on time.

It will be apparent to those skilled in the art that variations and modifications of the present invention can be made without departing from the scope or spirit of the invention. For example, the components and arrangement of the hydraulic valve actuation system and the hydraulic control valves used therewith are presented as examples only. Furthermore, while the systems have been described as being provided in first and second housings 312 and 313, it is appreciated that the system elements could be provided in a single housing, or in more than two housings. It is contemplated that modifications and variations of the valve actuation system and control valves may be used in alternative embodiments of the invention without departing from the scope of the appended claims. Thus, it is intended that the scope of the present claims cover all such modifications and variations of the invention.

What is claimed is:

1. A system for transferring engine valve actuation motion between first and second valve train elements, said system comprising:

an actuator piston bore formed in the second valve train element;

an actuator piston slideably disposed in the actuator piston bore;

a solenoid control valve;

a first hydraulic fluid supply passage connected to the solenoid control valve;

a hydraulic circuit extending between the actuator piston bore and the solenoid control valve;

a solenoid actuated valve disposed in said hydraulic circuit between the solenoid valve and the actuator piston bore;

a means for expanding the volume of the hydraulic circuit during times when the solenoid control valve opens to provide hydraulic fluid from the first hydraulic fluid supply passage to the solenoid actuated valve;

a bypass circuit included in the hydraulic circuit, the bypass circuit extending between the means for expanding and the actuator piston bore, and the bypass circuit extending around the solenoid actuated valve; and a first check valve disposed in the bypass circuit.

2. The system of claim 1 wherein the means for expanding the volume of the hydraulic circuit comprises a hydraulic fluid accumulator.

3. The system of claim 1, further comprising:

a second hydraulic fluid supply passage connected directly to the hydraulic circuit.

4. The system of claim 3, further comprising:

a second check valve disposed in the second hydraulic fluid supply passage.

5. The system of claim 2 wherein the hydraulic fluid accumulator includes one or more accumulator springs with a spring load greater than a hydraulic pressure of the first hydraulic fluid supply passage.

6. The system of claim 1 wherein the first valve train element is a rocker arm.

7. The system of claim 1 wherein the second valve train element is a rocker arm.

8. A system for transferring engine valve actuation motion between first and second valve train elements, said system comprising:

an actuator piston bore formed in the second valve train element;

an actuator piston slideably disposed in the actuator piston bore;

a solenoid control valve;

a first hydraulic fluid supply passage connected to the solenoid control valve;

a hydraulic circuit extending between the actuator piston bore and the solenoid control valve;

a solenoid actuated valve disposed in said hydraulic circuit between the solenoid valve and the actuator piston bore;

a means for expanding the volume of the hydraulic circuit during times when the solenoid control valve opens to provide hydraulic fluid from the first hydraulic fluid supply passage to the solenoid actuated valve;

a check valve disposed in the hydraulic circuit between the solenoid actuated valve and the actuator piston bore, wherein the solenoid actuated valve comprises a poker piston having a pin-shaped extension adapted to selectively open the check valve, wherein an area of the poker piston exposed to hydraulic pressure from the hydraulic circuit is less than an area of the actuator piston exposed to hydraulic pressure from the hydraulic circuit, and wherein the means for expanding the volume of the hydraulic circuit comprises:

a means for biasing the actuator piston into the actuator piston bore, said means for biasing the actuator piston having a first spring load value; and a means for biasing the poker piston toward the check valve, said means for biasing the poker piston having a second spring load value, wherein the first spring load value is less than the second spring load value, and the second spring load value is less than a hydraulic pressure of the first hydraulic fluid supply passage.

9. The system of claim 8, wherein the means for expanding the volume of the hydraulic circuit further comprises a pressure relief passage.

10. The system of claim 9, wherein the means for expanding the volume of the hydraulic circuit further comprises a hydraulic fluid pressure relief valve connected to the hydraulic fluid pressure relief passage.

11. A system for transferring engine valve actuation motion between first and second valve train elements, said system comprising:

an actuator piston bore formed in the second valve train element;

an actuator piston slideably disposed in the actuator piston bore;

a solenoid control valve;

a first hydraulic fluid supply passage connected to the solenoid control valve;

a hydraulic circuit extending between the actuator piston bore and the solenoid control valve;

a solenoid actuated valve disposed in said hydraulic circuit between the solenoid valve and the actuator piston bore; and a means for expanding the volume of the hydraulic circuit during times when the solenoid control valve opens to provide hydraulic fluid from the first hydraulic fluid supply passage to the solenoid actuated valve.

a first hydraulic passage in said hydraulic circuit extending between the solenoid actuated valve and a mid-portion of the actuator piston bore;

a second hydraulic passage in said hydraulic circuit extending between the solenoid actuated valve and an end wall portion of the actuator piston bore;

a check valve disposed in the second hydraulic passage; and means for biasing the actuator piston into the actuator piston bore, wherein the solenoid actuated valve comprises a slug which selectively isolates the second hydraulic passage from hydraulic fluid communication with the solenoid control valve, and wherein the means for expanding the volume of the hydraulic circuit comprises:

an annular recess provided in the actuator piston adapted to become unregistered with the first hydraulic passage when the actuator piston in an upward-most position; and a vent passage extending from the annular recess to a bottom surface of the actuator piston.

12. The system of claim 11, wherein the means for expanding the volume of the hydraulic circuit further comprises means for biasing the slug such that the slug serves as an accumulator piston.

13. The system of claim 11, wherein the means for expanding the volume of the hydraulic circuit further comprises a vent provided in the hydraulic circuit.

14. A system for transferring engine valve actuation motion between first and second valve train elements, said system comprising:

an actuator piston bore formed in the second valve train element;

an actuator piston slideably disposed in the actuator piston bore;

a solenoid control valve;

a first hydraulic fluid supply passage connected to the solenoid control valve;

a solenoid actuated valve bore in hydraulic communication with the solenoid control valve;

a solenoid actuated valve piston slideably disposed in the solenoid actuated valve bore, said solenoid actuated valve piston having first, second and third annular recesses;

means for biasing the solenoid actuated valve piston towards the solenoid control valve;

a second hydraulic fluid supply passage connected to the solenoid actuated valve bore;

a first hydraulic fluid vent passage connected to the solenoid actuated valve bore;

a second hydraulic fluid vent passage connected to the solenoid actuated valve bore;

a first actuator hydraulic passage extending between an upper portion of the actuator bore and the solenoid actuated valve bore; and a second actuator hydraulic passage extending between a lower portion of the actuator bore and the solenoid actuated valve bore, wherein the position of the solenoid actuated valve piston is selectively controlled by the solenoid control valve to provide hydraulic communication (1) between the second hydraulic fluid supply passage and the first actuator hydraulic passage, and between the second hydraulic fluid vent passage and the second actuator hydraulic passage, and (2) between the second hydraulic fluid supply passage and the second actuator hydraulic passage, and between the first hydraulic fluid vent passage and the first actuator hydraulic passage.

15. The system of claim 14, further comprising a check valve in the second hydraulic fluid supply passage.

16. The system of claim 14 wherein the first valve train element is a rocker arm.

17. The system of claim 16 wherein the second valve train element is a rocker arm.

18. The system of claim 14, further comprising:

central upper extension extending from the actuator piston towards the first valve train element; and at least a partial hydraulic seal between the central upper extension and a portion of second valve train element defining an upper portion of the actuator piston bore.

* * * * *